US005150902A

United States Patent [19]

Heisler

[11] Patent Number: 5,150,902

[45] Date of Patent: Sep. 29, 1992

[54] GOLFER WEIGHT DISTRIBUTION MEASUREMENT SYSTEM

[76] Inventor: Doyle J. Heisler, 528 11th Cir., Spearfish, S. Dak. 57783

[21] Appl. No.: 727,470

[22] Filed: Jul. 9, 1991

[51] Int. Cl.[5] ..... A63B 69/36

[52] U.S. Cl. ..... 273/186.1; 273/26 R; 273/187 B

[58] Field of Search ..... 273/187 R, 186 R, 26 R

[56] References Cited

U.S. PATENT DOCUMENTS

| | | | |
|---|---|---|---|
| 3,169,022 | 2/1965 | Kretsinger | 273/183 |
| 4,136,387 | 1/1979 | Sullivan et al. | 364/410 |
| 4,577,868 | 3/1986 | Kiyonaga | 273/183 A |
| 4,713,686 | 12/1987 | Ozaki et al. | 358/107 |

OTHER PUBLICATIONS

Article, "Weight Shift Our Exclusive Tests Reveal the Tour Swing has Changed Dramatically Over the Last Generation" by Lew Fishman, *Golf Digest*, Apr. 1989.

*Primary Examiner*—William H. Grieb

*Attorney, Agent, or Firm*—Merchant, Gould, Smith, Edell, Welter & Schmidt

[57] ABSTRACT

An apparatus for measuring a sportsman's weight distribution during a practice swing includes a detector (60) for sensing weight upon a first and second detection pad (30) constructed and arranged to receive the sportman's feet. The detector (60) generates weight signals as a function of the weight upon the pads (30). A controller (21) receives the weight signals and generates a data output set representative of the change in weight distribution upon the first and second detection pads (30) with reference to a point (42) within the practice swing. A reference detector (22) generates a reference signal corresponding to impact by the sportman (12) upon a ball (16) which corresponds to the reference point within the practice swing. Each of the detection pads (30) comprises a base (32) and at least one cantilevered member (34) mounted in spaced, cantilevered relation relative to the base and disposed to receive one of the sportsmens feet. A weight sensing gauge (60) is operationally mounted on each of the cantilevered members (34) for sensing the weight thereon and generating weight signals. The output data set is stored and can be displayed either immediately or at a later time.

22 Claims, 5 Drawing Sheets

IMPACT R=65 L=35 92

5 IRON 94

DRAW 96

FIG. 8
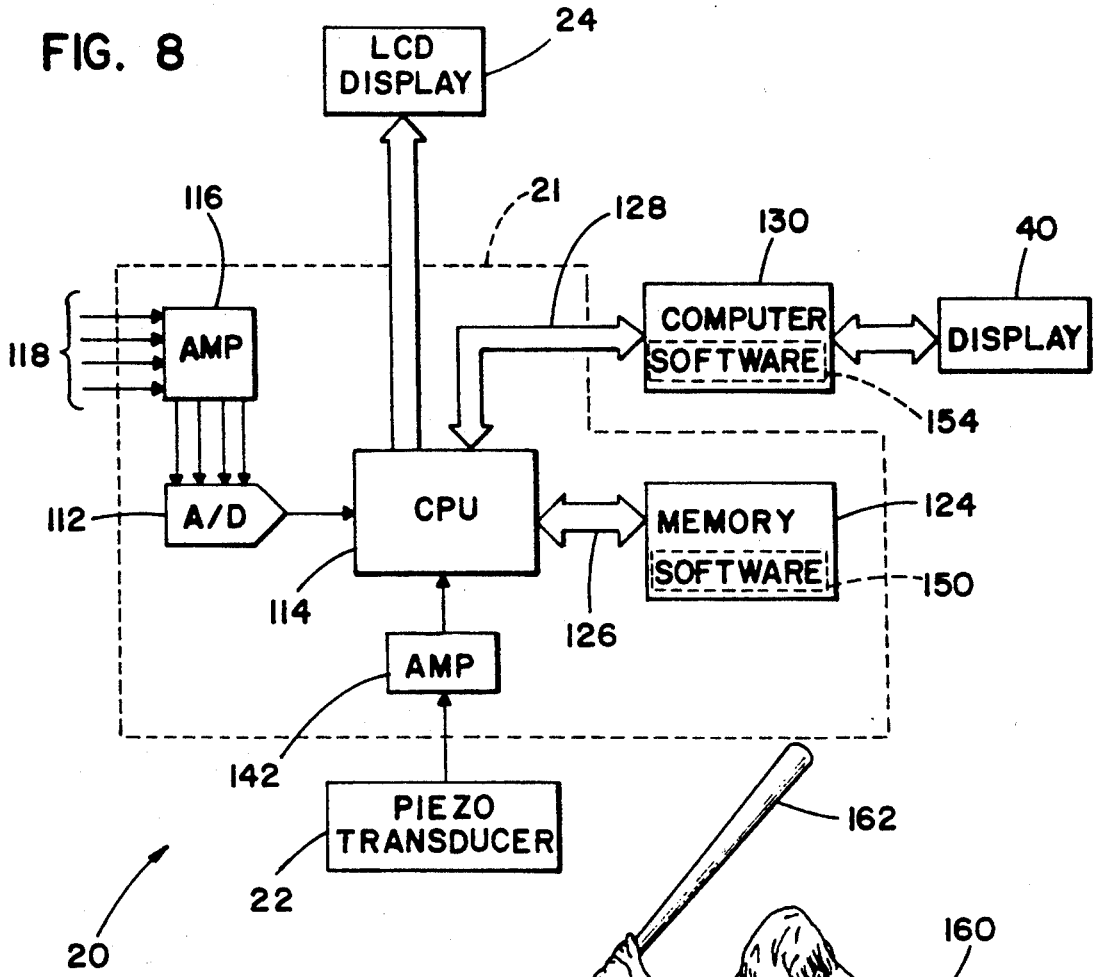
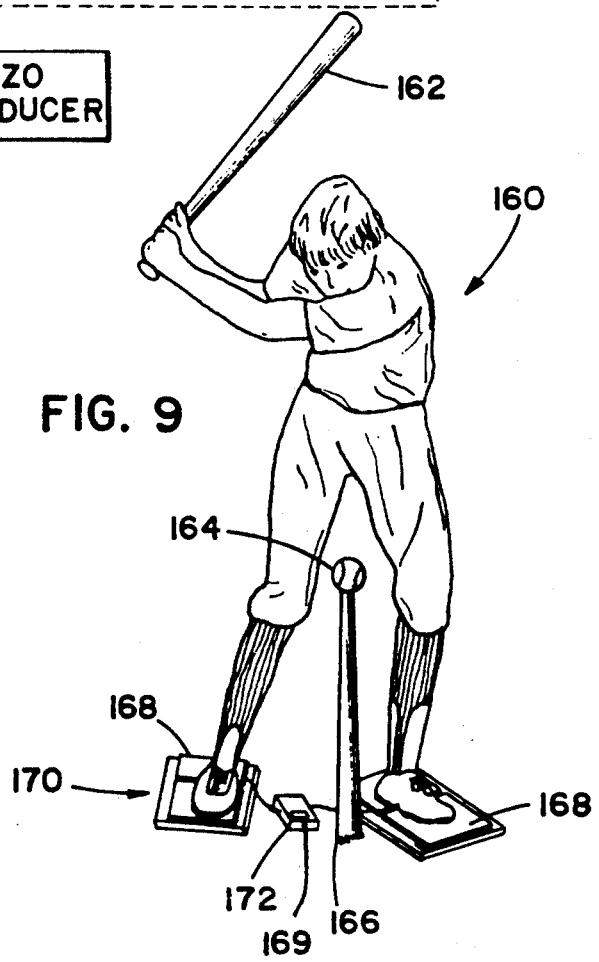
FIG. 9

GOLFER WEIGHT DISTRIBUTION MEASUREMENT SYSTEM

TECHNICAL FIELD OF THE INVENTION

The present invention pertains generally to the field of golf practice aids, and more particularly to a system for weight distribution measurement of a golfer during a practice swing.

BACKGROUND OF THE INVENTION

In a proper golf swing, leg drive and weight shift are important elements. Weight distribution during the golf swing is one of the primary factors of ball distance. An article entitled "Weight Shift", *Golf Digest* (April 1989), reported that weight shift is an important feedback mechanism for golfers. If a golfer has a proper fluid weight shift from the beginning of the swing to its end, the golfer's balance, eye contact, ball flight, and overall ball distance gain consistency.

Golf professionals spend hours teaching golfers the important aspects of the golf swing. When golfers hit balls at driving ranges they receive immediate feedback from club selection, ball distance and ball curvature, but they do not receive feedback on weight distribution during the golf swing. Although weight shift is only one aspect of the golf swing, it is one of the most essential aspects in attaining accuracy of ball direction and maximum distance, and in avoiding significant problems such as a slice or hook. Therefore, weight shift is an important tool for analyzing the golf swing. In addition to a need for a system to provide immediate weight distribution feedback to the golfer at the driving range or golf course, weight distribution data which could be analyzed more carefully at a later time would provide a further tool for the golfer.

U.S. Pat. No. 4,577,868 to Kiyonaga issued Mar. 25, 1986 discloses a golf swing practice device for detecting the golfer's weight placed on address plates having a pair of sensors. Kiyonaga attempts to perfect the golf swing by teaching proper timing and rhythm such that the swing gains consistency. A series of chimes are adjusted to signal a golfer to be at particular positions within the golf swing at particular times. The golfer is allowed to visually confirm movement through the golfer's swing with the aid of a weight shift indicator.

U.S. Pat. No. 3,169,022 to Kretsinger issued Feb. 9, 1965 discloses a means for indicating the distribution of a golfer's weight at the instant of ball impact. Kretsinger utilizes a pair of sensing pads coupled to a ball support platform. An indicator notes or records the weight distribution at time of impact. The connections between the elements of Kretsinger and the use of a particular ball support platform to sense impact during the swing, limits the portability of this system. In addition, it is important to have data representative of the weight shift during the entire golf swing and not only at the point of impact.

The prior art devices do not provide a portable weight distribution measurement apparatus capable of providing weight shift measurement during the entire golf swing. In addition, the devices do not provide a means for obtaining such data so as to provide immediate feedback after the swing and also provide the golfer with data to be analyzed at a later time.

SUMMARY OF THE INVENTION

A portable weight distribution measurement apparatus of the present invention provides feedback to a golfer with regard to golfer's weight shift either immediately after a practice swing or at a later time. The apparatus includes a detector for sensing weight upon a first and second detection pad, each of which is disposed to receive one of the golfer's feet. The detector generates weight signals as a function of the weight sensed. A controller receives the weight signals and generates a data output set representative of the change of weight distribution upon the first and second detection pad with reference to impact of the golfer's club upon a ball during the practice swing. An impact detector senses the impact of the golfer's club upon the ball and generates an impact signal indicative thereof. The controller receives the impact signal and generates the data output set with reference to the impact signal, whereby the golfer's weight distribution is measured for the golfer's entire swing.

In a preferred embodiment, the first and second detection pads each comprise a base and at least one cantilevered member mounted in spaced, cantilevered relation relative to the base and disposed to receive one of the golfer's feet. The cantilevered members have weight sensors operationally mounted thereon for sensing the weight of the golfer and for generating weight signals corresponding thereto.

In another preferred embodiment, the weight sensors comprise strain gauges. Strain gauges can provide accurate measurements, if utilized with proper mechanical designs. By the use of two pads in complimentary relation with complimentary strain gauges for measuring the percentage of weight shift, any accuracy problems are effectively overcome. With the use of strain gauges, a relatively accurate, inexpensive, and easily maintained portable device can be provided.

In a further preferred embodiment, the weight distribution measurement apparatus comprises memory for storing the data output set so that it can be analyzed at a later time. The apparatus also includes input means for inputting additional reference information with regard to the swing and stores the information so it can be later retrieved with the data output set. A display is also provided for displaying the output data set or portions thereof, either immediately after the practice swing or at a later time.

In yet a further preferred embodiment, the detection pads include a first and second cantilevered member mounted at opposite ends of the base and extending inward therefrom in opposed relation. The first member is disposed for receiving the heel of the golfer's foot, while the second member is disposed for receiving the ball of the golfer's foot. Weight sensing means is operationally mounted on each of the cantilevered members for sensing the weight thereon and generating weight signals corresponding thereto. A controller then receives the weight signals and generates an output data set representative of the change in weight distribution upon each cantilevered member.

BRIEF DESCRIPTION OF THE DRAWINGS

FIG. 8 shows a block diagram of portions of the weight distribution measurement system; and FIG. 9 shows an alternative embodiment of the present invention for use with the sport of baseball.

DETAILED DESCRIPTION OF THE INVENTION

In the following description of the invention, reference is made to the accompanying drawings which form a part hereof, and in which is shown by way of illustration, a specific embodiment in which the invention may be practiced. It is to be understood that other embodiments may be utilized and structural changes made without departing from the scope of the present invention.

Figure 1:
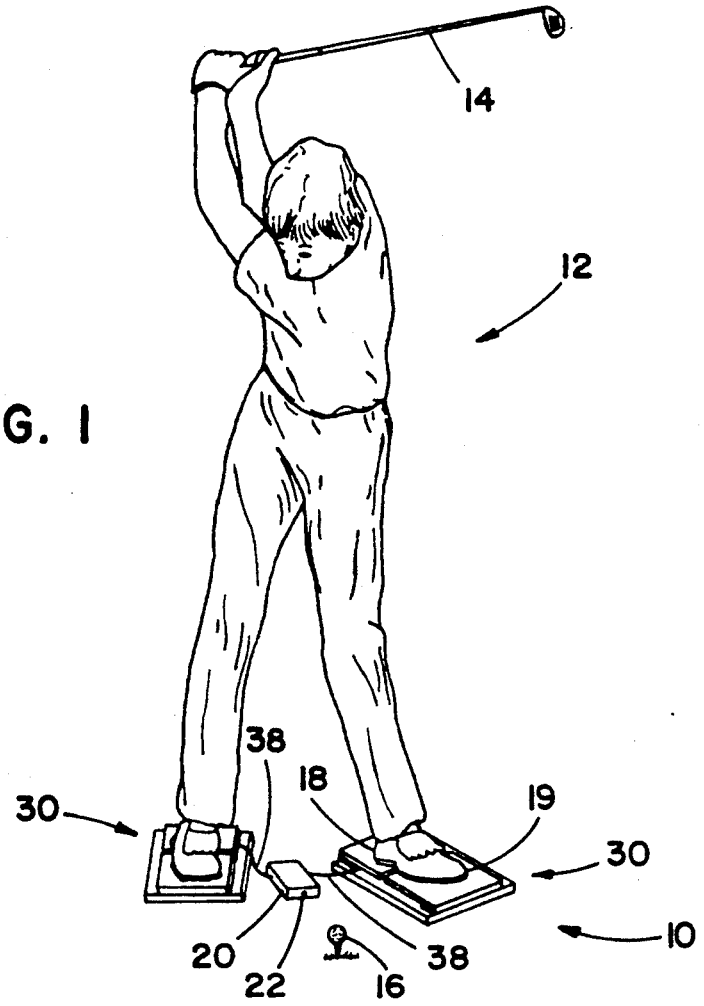
FIG. 1 shows a golfer utilizing the weight distribution measurement system of the present invention.
Figure 5:
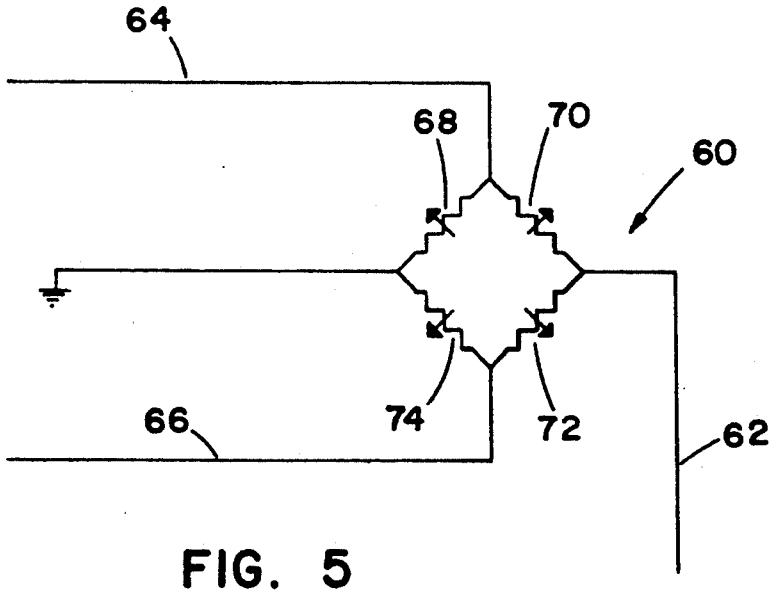
FIG. 5 is a schematic of one of the gauges positioned on the cantilevered members of the detection pad shown in FIG. 3 and 4.
Figure 3:
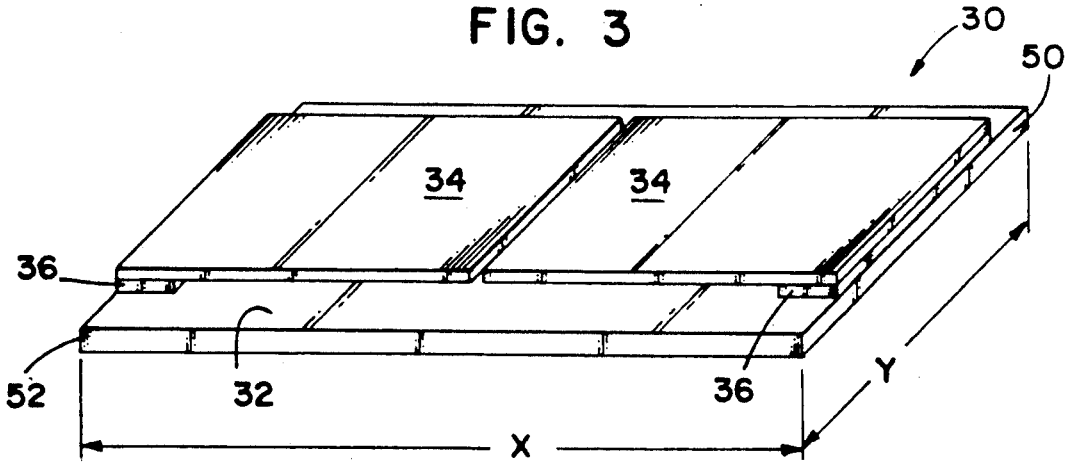
FIG. 3 shows a perspective view of one of the weight detection pads of the weight distribution measurement system shown in FIG. 1.
Figure 4:
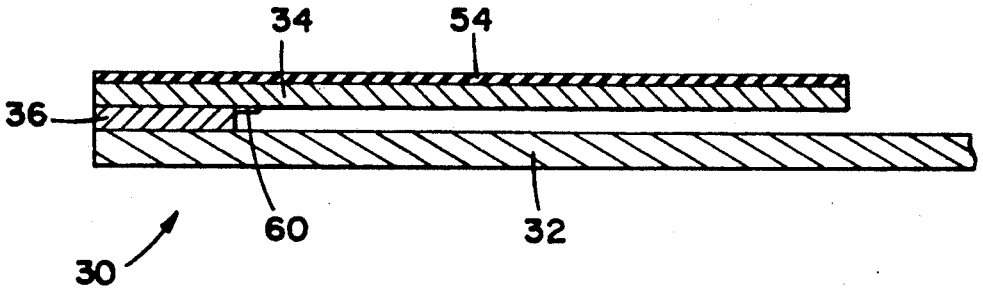
FIG. 4 shows a partial side view of the weight detection pad shown in FIG. 3.

Referring now to the drawings, and in particular to FIG. 1, the preferred embodiment will be described. A weight distribution measurement apparatus 10 is used to analyze the golf swing of a golfer 12. During the golfer's swing of a club 14, the weight distribution measurement apparatus measures the golfer's weight shift from address of a golf ball 16 through the golfer's finish. The weight distribution apparatus 10 includes a first and second detection pad 30 for placement of the golfer's feet as the golfer addresses the ball 16. Each detection pad includes two cantilevered members 34 coupled to base 32 via offset blocks 36 as shown in FIG. 3 and FIG. 4. Each of the cantilevered members has a strain gauge 60 positioned thereon to sense the amount of weight on each pad and generate weight signals applied to computer module 20 via lines 38.

Computer module 20 includes a piezo transducer 22 for sensing the sound of impact of club 14 on golf ball 16 as the golfer 12 practices. Computer module 20 receives an impact signal from the piezo transducer 22 and in combination with the weight signals from the detection pads 30, generates a digital data output set representative of the weight signals with reference to the impact signal received from the piezo transducer 22.

Figure 2:
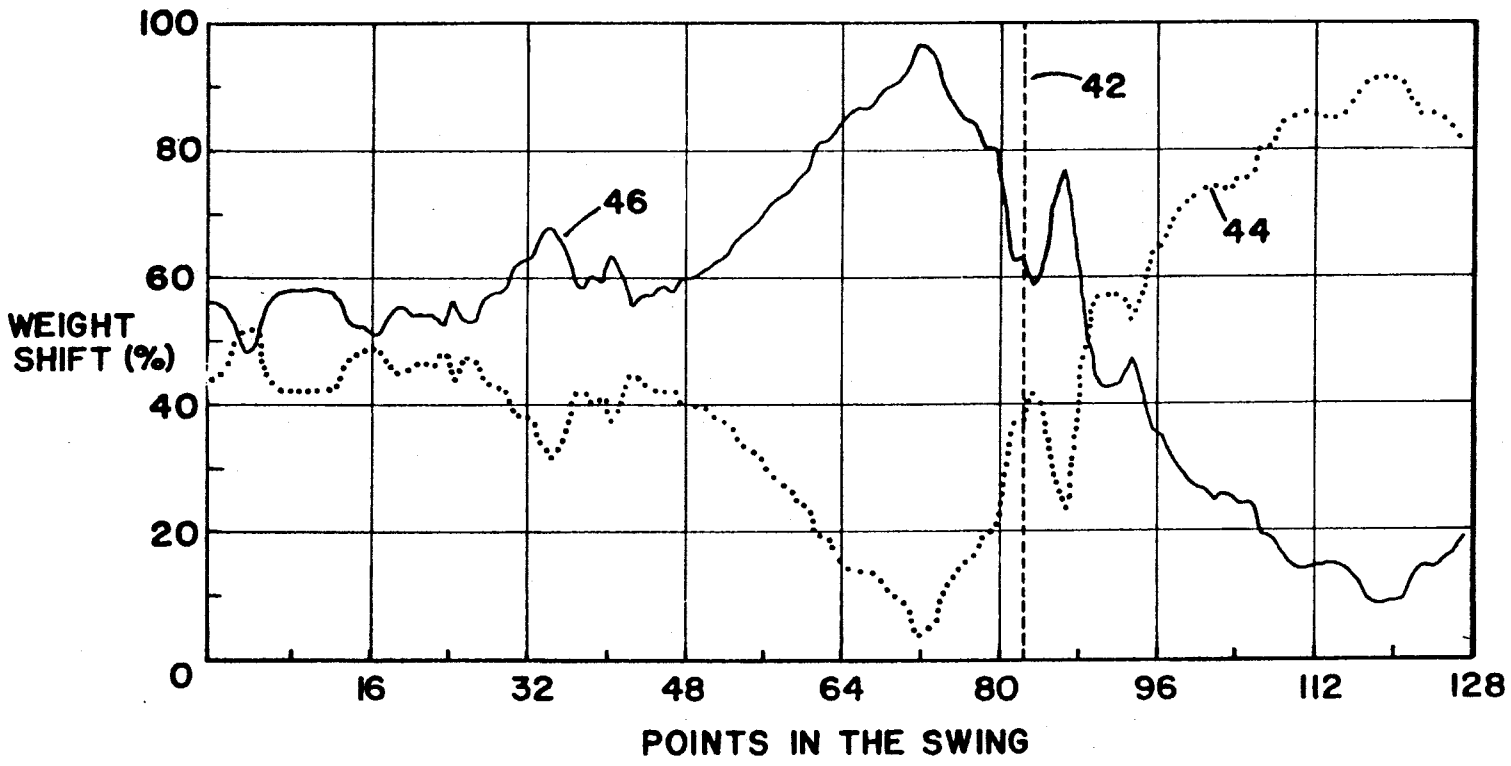
FIG. 2 shows a computer display of a manipulated data output set generated by the weight distribution measurement system of the present invention.
Figures 6, 7A, 7B, 7C:
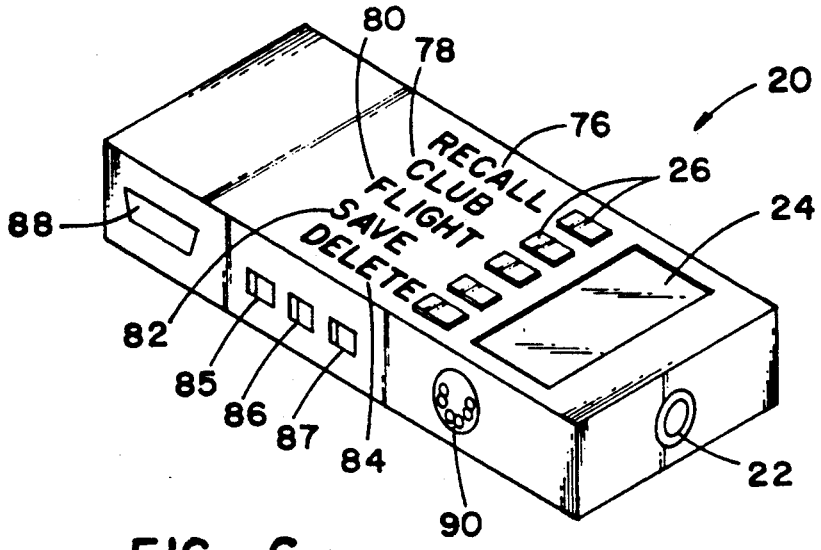
FIG. 6 is a perspective view of the computer module of the weight distribution measurement system shown in FIG. 1.
FIG. 7A-C show LCD displays during use of the weight distribution measurement system.

As shown by the block diagram of FIG. 8, the data generated under the control of memory software 150 by the computer module 20 is stored in memory 124, displayed in portion on liquid crystal display (LCD) 24 of computer module 20, and/or connected to another computer 130 and display 40 via a serial port 88 of module 20 (FIG. 6). Software associated with computer display 40 can access the data output set, and manipulate and display results thereof. For example, these results can take the form of the graphic representation displayed by the PC display 40 shown in FIG. 2. As shown in FIG. 2, the percentage of weight shift of the right side 46 of the golfer increases substantially prior to impact (reference number 42) and then decreases substantially after impact 42. Also, percentage of weight shift on the golfer's left side 44 decreases substantially prior to impact 42 and increases substantially after impact 42. From this weight distribution data a golfer may analyze his golf swing, not only for percentage of weight shift, but also for smoothness of the weight shift to determine whether the golfer's swing was fluid.

Referring now to FIGS. 1-8 the weight distribution measurement system shall be described in further detail. As discussed above, the weight distribution measurement apparatus includes two weight detection pads 30, best shown in FIGS. 3 and 4. The weight distribution pads are sized to accommodate a golfer's foot. The preferred measurements of the detection pad are approximately 16 inches in length (X) and 10 inches in width (Y). Each detection pad 30 includes a base 32 having two opposed cantilevered members 34 respectively mounted at opposite ends 50, 52 of base 32 by an offset block 36. Each offset block 36 is approximately 3/16 of an inch in height providing for an adequate space between cantilevered member 34 and base 32 for deflection of the cantilevered member when weight is placed thereon. The weight detection pad 30 is further covered with a rubber coating 54, FIG. 4, to prevent the golfer from slipping.

Positioned on the lower surface of each cantilevered member 34 adjacent the block 36 is a strain gauge 60. The strain gauge 60, shown schematically in FIG. 5, includes a Wheatstone bridge including resistors, 68, 70, 72, 74. DC voltage is applied across the bridge via lines 64 and 66. Signals representative of the weight applied upon the cantilevered member are output on line 62. The strain gauges selected for this design are Model N2A-XX-S056R-350, manufactured by Measurement Group, Inc.

It should be readily apparent that, since each cantilevered member has a strain gauge attached thereto, weight shift from various parts of the golfer's foot are sensed and measured throughout the golf swing. Of the two cantilevered members 34, one is for positioning the ball 19 of the golfer's foot and the other for the golfer's heel 18. Weight signals are generated from each of the strain gauges 60 of each of the cantilevered members 34 and are received by computer module 20.

The computer module in the preferred embodiment generates an output data set under the control of software 150 representative of the combined weight of both the heel and ball to represent the total percentage weight distribution of the golfer with respect to each detection pad. This data output set represents weight distribution at numerous points throughout the golf swing, in the preferred embodiment approximately 200. Rather than combined weight, the output data set generated could represent the individual and separate weight of the ball and heel of each of the golfer's feet. Much like the PC display 40 of FIG. 2, a display representative of the weight shift of each of these particular areas of the feet could be provided.

In addition, the detection pads could include any number of cantilevered members. For example, there could be four cantilevered members on each detection pad 30, whereby weight distribution measurements could be made of the ball, heel, and each side of the golfer's foot. This additional data would also be helpful to the golfer in the analysis of the golfer's swing.

As shown in the block diagram of FIG. 8, the analog signals representative of the weight upon the cantilevered members 34 are applied via lines 118 to bridge amplifier 116 of controller 21 within control module 20. Bridge amplifier 116 includes four amplifier networks, one for each gauge on each cantilevered member. Each amplifier network includes two cascaded operational amplifiers connected in a non-inverting configuration. The amplified signals are applied to an A/D converter 112 and the digitized signals are applied to CPU 114. In the preferred embodiment, the A/D converter 112 and CPU 114 are contained in single chip, 80C198, such as manufactured by Intel.

At initialization, prior to receiving the golfer's feet, control module 20 receives baseline signals from the strain gauge 60 of each cantilevered member 34. After the golfer is positioned on the detection pads 30, the CPU 114 under the control of software 150 receives four digitized and multiplexed weight signals from the four cantilevered members 34. The weight signals are compared to the baseline signals to provide scale signals representative of the weight upon each cantilevered member 34. The two signals representative of the combined weight upon each detection pad 30 are compared to the total weight upon both pads and weight percentages upon the pads are generated. Because the strain gauges are used in complimentary relation and used to measure percentage of weight rather than actual weight upon the detection pads 30, accurate percentage measurements are effectively made. The percentage of weight upon each detection pad 30 is then stored in memory 124.

CPU 114 receives an impact signal from the piezo transducer 22 which senses the sound of impact of the golf club 14 upon the golf ball 16. The impact signal is amplified by amplifier 142, consisting of two cascaded operational amplifiers connected in a noninverting configuration. CPU 114 under the control of software 150 generates an output data set utilizing the stored weight percentages on each detection pad representative of the weight distribution on the detection pads a certain period prior to impact, at impact, and a certain period of time after impact is detected. The data set is stored in memory 124.

Computer module 20 being a very small unit lends to the portability of the measurement system. Module 20, FIG. 6, includes on its face a liquid crystal display (LCD) 24 and input pad 26. The input pad 26 includes buttons marked "Recall", "Club", "Flight", "Save", and "Delete". The input pad 26 and LCD 24 function as the user interface to the system.

The golfer can utilize the apparatus in two different ways. If the user selects the stand-alone position for the computer/stand-alone switch 87 (FIG. 6), the system is set to be used alone at the driving range to provide immediate feedback to the golfer or to store data for later analysis. If the computer position is selected, then the unit is set to function with another computer to analyze the data either immediately or at a later time.

In the computer mode, the control module 20 is connected to another computer 130 and display 40 by the serial port 88 (FIG. 6). Instead of storing the data output set generated by the system in the module's memory 124, the data set is sent directly to the memory of computer 130. Computer 130 provides a more detailed display to the golfer as shown in FIG. 2. In this manner, the device can be used indoors with a net for practice.

In both the stand-alone mode and computer mode, and after the system is initialized by the ON/OFF switch 85, the LCD 24 displays "Swing Away". Depending upon whether the system is in an A-mode or B-mode, set by mode switch 86, FIG. 6, the golfer can either swing away and the data generated under the control of the software will be stored automatically (A-mode) or the data can be viewed immediately and stored with additional reference information as described below by selection of the save button (B-mode).

In the stand-alone mode and upon selection of "Recall" button 76, after the golfer has completed his swing, a display such as that shown in FIG. 7A will show the golfer's percentage weight distribution at address, forward press, at the top of his swing, impact, post impact, and finish. Each of the weight distribution percentages is shown separately as the golfer increments through them by further selection of the Recall button 76. The golfer can then combine the weight distribution information with knowledge of the club used and the ball flight to analyze the golf swing just completed.

The golfer can save additional valuable reference information to be analyzed later by selecting the "Club" button 78 and/or "Flight" button 80 to input reference information concerning the golf swing data to be saved. When the Club button 78 is selected, the LCD 24 (FIG. 7B) will display a club selection which can be incremented by further selection of the Club button 78 until the club utilized is displayed. The club selections are preprogrammed and can include any club the golfer utilizes. In the preferred form, the club selection includes a range of wood drivers, irons, and wedges. The same is true for selection of the Flight button. When the ball flight button is selected after the golf swing, the ball flight selections are incremented and selected. For example, the ball flight selections include, slice, push, straight, draw and hook.

After this additional information is inputted, the golfer can press the save button 82 and the data output set generated by CPU will be stored in memory 124 along with the club selection and ball flight information. The same procedure for storing additional reference information applies when the system is in the computer mode as it does in the stand-alone mode.

When the Delete button 84 is selected, the data representative of the last golfer's swing is purged from memory and the golfer may continue to swing away.

The computer module 20 can further be connected via serial port 88 to computer 130 after having been used in the stand-alone mode. Software 154 of computer 130 can then access and manipulate the data stored in memory 124 of computer 20 to generate displayable results on display 90.

Although the weight distribution measurement system has been described thus far with reference to golf, this system is applicable to other sports, for example baseball. As shown in FIG. 9, baseball player 160 is positioned upon weight detection pads 168 of the same type used and described previously. The baseball player's swing of bat 162 can be analyzed via the weight distribution measurement apparatus 170. The sound of impact of the baseball bat 162 with baseball 164 set upon a large tee 166 is sensed by a piezo transducer 169 and generates an impact signal received by control module 172, equivalent to the control module previously described. The control module would then generate an output data set representative of the weight signals from detection pads 168 during the baseball player's swing and referenced about the impact of the baseball bat 162 on the baseball 164.

Although the present invention has been described above in a preferred form, those skilled in the art will readily appreciate that various modifications may be made to it without departing from the spirit and scope of the invention as bounded by the claims of the application itself.

What is claimed is:

1. An apparatus for measuring a sportsman's weight distribution during a practice swing, comprising:

detection means for sensing the sportsman's weight comprising first and second detection pads, each pad being constructed and arranged to receive one of the sportsman's feet, and for generating weight signals as a function of weight thereon;

reference detection means for sensing an event occurrence corresponding to a point in said practice swing and generating a reference signal corresponding to said event occurrence; and control means for receiving said weight signals and said reference signal and for generating a data output set representative of the change in weight distribution upon said first and second detection pads prior to, at, and subsequent to said event occurrence during said practice swing.

2. The apparatus according to claim 1, wherein each of said detection pads comprises a base and at least one cantilevered member mounted in spaced, cantilevered relation relative to the base and disposed to receive one of said sportsman's feet, and wherein said detection means includes weight sensing means operationally mounted on said cantilevered member for sensing the weight thereon and for generating weight signals as a function thereof.

3. The apparatus according to claim 2, wherein each of said detection pads includes first and second cantilevered members mounted at opposite ends of said base extending inward therefrom in opposed relation, said first cantilevered member being disposed for placement of the heel of said sportsman's foot, said second member being disposed for placement of the ball of said sportsman's foot, said weight sensing means being operationally mounted on each of said cantilevered members for sensing the weight thereon and for generating weight signals as a function thereof, said control means for receiving said weight signals and for generating an output data set representative of the change in weight distribution upon each cantilevered member.

4. The apparatus according to claim 2, wherein said weight sensing means comprises a strain gauge transducer.

5. The apparatus according to claim 1, wherein said event occurrence comprises impact with a ball by the sportsman during said practice swing and wherein said reference detection means includes impact sensing means separably positioned from said ball for sensing said impact and generating a corresponding reference signal.

6. The apparatus according to claim 5 wherein said impact sensing means comprises a sound transducer separably positioned from said ball.

7. The apparatus according to claim 1 which further comprises means for storing said data output set representative of the change in weight distribution during said swing so that said data output set can be retrieved at a later time.

8. The apparatus according to claim 7 which further comprises:

means for inputting reference information data describing said practice swing; and means for storing said reference information data and associating said reference information data for retrieval with said data output set at a later time.

9. The apparatus according to claim 1 which further comprises display means for displaying at least a portion of said data output set immediately following said practice swing.

10. An apparatus according to claim 1, wherein said control means comprises:

means for amplifying said weight signals and said reference signal;

means for digitizing said amplified weight signals and said reference signal;

programming means for generating said output data set as a function of said weight signals and said reference signal so that said data output set is representative of the sportsman's weight distribution prior to, at, and after said event occurrence during said practice swing; and means for storing said data output set.

11. The apparatus according to claim 10 further comprising display means for displaying said stored data output set.

12. An apparatus for measuring a golfer's weight distribution during a golf swing, comprising:

weight detection means comprising first and second detection pads for sensing the golfer's weight and for generating weight signals as a function thereof, each of said detection pads being constructed to receive one of said golfer's feet;

impact detection means for sensing the impact of said golfer's club upon a ball and generating an impact signal indicative thereof; and control means for receiving said weight signals and said impact signal, and for generating a data output set representative of the change in weight distribution upon said first and second detection pads prior to, at, and subsequent to impact of said golfer's club upon said ball during said golf swing.

13. The apparatus according to claim 12 wherein each of said detection pads comprises a base and at least one cantilevered member mounted in spaced relation relative to the base and disposed to receive one of said golfer's feet, and wherein said detection means includes weight sensing means operatively mounted on said cantilevered member for sensing the weight thereon and for generating a weight signal as a function thereof.

14. The apparatus according to claim 13 wherein said weight sensing means comprises a strain gauge transducer.

15. The apparatus according to claim 12 further comprising means for storing said data output set representative of the change in weight distribution during said golf swing for later retrieval and analysis.

16. The apparatus according to claim 15 further comprising:

means for inputting club selection and ball flight reference information data describing said golf swing; and means for inputting club selection and ball flight reference information data describing said golf swing; and means for storing said reference information data and associating said reference information data for retrieval with said data output set at a later time.

17. The apparatus according to claim 15 which further comprises means for displaying at least a portion of said data output set immediately following said golf swing.

18. The apparatus according to claim 12 wherein each of said detection pads includes first and second cantilevered members mounted at opposite ends of said base extending inward therefrom in opposed relation, said first cantilevered member being disposed for placement of the heel of said golfer and said second cantilevered member being disposed for placement of the ball of said golfer's foot, said weight sensing means being operationally mounted on each of said cantilevered members for sensing the weight thereon and for generating weight signals as a function thereof, said control means for receiving said weight signals and for generating an output data set representative of the change in weight distribution upon each cantilevered member.

19. The apparatus according to claim 12 wherein said impact detection means comprises a sound transducer separably positioned from said golf ball.

20. A method for measuring a golfer's weight distribution during a golf swing, comprising the steps of:

providing a pair of weight detection pads, each of said detection pads having a base and at least one cantilevered member mounted in spaced, cantilevered relation relative to the base and disposed to receive one of said golfer's feet;

sensing the weight upon said detection pads during said golf swing;

generating weight signals as a function of the weight sensed upon said detection pads;

sensing the impact of said golfer's club upon a ball;

generating an impact signal indicative of said impact of said golfer's club upon said ball;

generating a data output set as a function of said weight signals and said impact signal representative of the change in weight distribution upon said detection pads with reference to said impact of said golfer's club upon said ball.

21. A method according to claim 20 further comprising the step of storing said output data set in memory.

22. A method according to claim 21 further comprising the step of displaying said data output set representative of the weight distribution of said golfer during said golf swing as a function of the weight signals and impact signal.

* * * * *